United States Patent [19]

Bohan, Jr.

[11] Patent Number: 4,770,629

[45] Date of Patent: Sep. 13, 1988

[54] STATUS INDICATOR FOR SELF-ENERGIZING BURNER CONTROL SYSTEM

[75] Inventor: John E. Bohan, Jr., Minneapolis, Minn.

[73] Assignee: Honeywell Inc., Minneapolis, Minn.

[21] Appl. No.: 24,438

[22] Filed: Mar. 11, 1987

[51] Int. Cl.[4] ..... F23Q 9/08

[52] U.S. Cl. ..... 431/59; 431/42; 431/53; 431/80

[58] Field of Search ..... 431/42, 54, 53, 80, 431/14, 16, 59; 137/66

[56] References Cited

U.S. PATENT DOCUMENTS

| | | | |
|---|---|---|---|
| 3,861,586 | 1/1975 | Katchka | 431/54 X |
| 4,529,373 | 7/1985 | Ortlinghaus | 431/59 X |
| 4,565,519 | 1/1986 | Carigread | 431/59 X |

FOREIGN PATENT DOCUMENTS

| | | | |
|---|---|---|---|
| 0087030 | 8/1978 | Japan | 431/80 |
| 0141934 | 12/1978 | Japan | 431/80 |
| 0026923 | 2/1983 | Japan | 431/80 |
| 0033424 | 2/1985 | Japan | 431/80 |
| 0194228 | 10/1985 | Japan | 431/80 |

OTHER PUBLICATIONS

Installation and Instruction Sheet identified as Form Number 60-2019-6, Honeywell Inc. Oct. 1982, Combination Gas Controls.

Catalog sheet from Linear Technology, Bang-Bang Controller, LTC1041, May 1985.

*Primary Examiner*—Samuel Scott
*Assistant Examiner*—Carl D. Price
*Attorney, Agent, or Firm*—Alfred N. Feldman

[57] ABSTRACT

A self-energizing burner control system for a fuel burner is accomplished by heat from a pilot flame energizing a thermoelectric generator. The thermoelectric generator supplies power to an oscillator. The oscillator has an output that is stepped up in voltage level and is converted to a regulated direct current potential. The regulated direct current potential in turn is used to operate a solid state temperature control or controller. This controller has a sampling rate that is visually indicated by a light emitting diode when a proper voltage is present. The system further insures that a temperature sensor is in place, and is functioning properly.

5 Claims, 2 Drawing Sheets

STATUS INDICATOR FOR SELF-ENERGIZING BURNER CONTROL SYSTEM

CROSS-REFERENCE TO RELATED APPLICATION

The present application is related to application Ser. No. 06/927,485 entitled "Self-Energizing Burner Control System For A Fuel Burner" which was filed on Nov. 6, 1986, and is now U.S. Pat. No. 4,696,639, which issued Sept. 29, 1987 by the present inventor, and which is assigned to the assignee of the present application.

BACKGROUND OF THE INVENTION

Self-energizing burner control systems of an electromechanical nature have been available for a number of years. The self-energizing systems typically use a thermoelectric generator that is made up of a group of thermocouples connected in series. These types of units have been marketed in the past, and Honeywell Inc. markets such a unit under the tradename Powerpile. The thermoelectric generator means or Powerpile is exposed to a pilot flame at a burner and generates a very low potential direct current. This very low power direct current voltage is applied to a special type of fuel valve, and is controlled by a mechanical thermostat so that the valve can be opened and closed in response to the thermostat. These types of systems have limited applications because of the frailties of the thermostat which must switch exceedingly low levels of direct current potential and current.

The cross-referenced application discloses a self-energizing burner control system in which the thermoelectric generator means or Powerpile is exposed to a pilot burner and generates a very low level of direct current potential. This very low level of direct current potential is used to drive an oscillator means. The oscillator means provides an alternating current output which is stepped up by a transformer. The output of the transformer, being higher in voltage than would ordinarily be available from a Powerpile, can be used with a rectifier and capacitor type of system to provide a direct current voltage of approximately five volts. This potential is then used to energize a very low power, solid state temperature control means. The solid state temperature control means includes a monolithic CMOS controller that is capable of being energized from approximately five volts direct current, and utilizes a very low amount of energy for its operation. The controller in turn operates a solid state switch that is in series with the valve of a type used with thermoelectric generator means.

The systems disclosed above are somewhat inconvenient to use in that manual operation of the valve means is required, while the potential from the Powerpile is initiated. A typical lighting instruction for a burner using this type of equipment would be that the manual operator should be held in an open position for at least three minutes after lighting the associated pilot to insure that the Powerpile output was adequate.

SUMMARY OF THE INVENTION

The present invention is directed to a self-energizing burner control system generally of the type earlier disclosed, but which has a novel arrangement to indicate that the voltage converter circuit in the device is functioning. A light emitting diode in a sampling circuit is arranged to provide a blinking indication when sufficient energy is available from the Powerpile and oscillator means so that a satisfactory working level of voltage has been attained. When a satisfactory working level of voltage is attained, the blinking of the light emitting diode indicates to the user that the manual opener need no longer be held. Also, the present improved circuit insures that the main fuel valve cannot be operated if the temperature sensing thermistor and related temperature setting circuit is either open circuited, or above some predetermined resistance level.

In accordance with the present invention, there is provided a status indicator for a self-energizing burner control system for burner means having a pilot burner and a main burner, including: fuel valve means for controlling fuel to said pilot burner and to said main burner; said fuel valve means including manual opening means and electromagnetic hold means with said manual opening means operable to open said valve means to admit said fuel to said pilot burner to permit ignition of fuel at said pilot burner which enables said electromagnetic hold means; said valve means further having electromagnetic operating means for control of said fuel to said main burner; thermoelectric generator means responsive to a flame from said pilot burner to generate a direct current potential; solid state switch means and said electromagnetic operating means for said valve means connected in series to said direct current potential wherein the operation of said solid state switch means controls said direct current potential to in turn control said valve means to admit said fuel to said main burner; power converter means having an input connected to said thermoelectric generator means, and further having direct current power supply output means to supply a direct current potential substantially higher in voltage than the voltage from said thermoelectric generator means; solid state temperature control means energized from said power converter means; said solid state temperature control means including a temperature sensor responsive to a temperature to be controlled; said temperature control means further having an output connected to said solid state switch means; said solid state temperature control means controlling said solid state switch means to energize said electromagnetic means for control of said fuel to said main burner; and circuit means including light emitting means connected to said solid state temperature control means with said light emitting means emitting a visible light when said solid state temperature control means is energized and functioning to thereby verify that said thermoelectric generator means is supplying sufficient power to operate said burner control system.

DESCRIPTION OF THE PREFERRED EMBODIMENT

Figure 1:
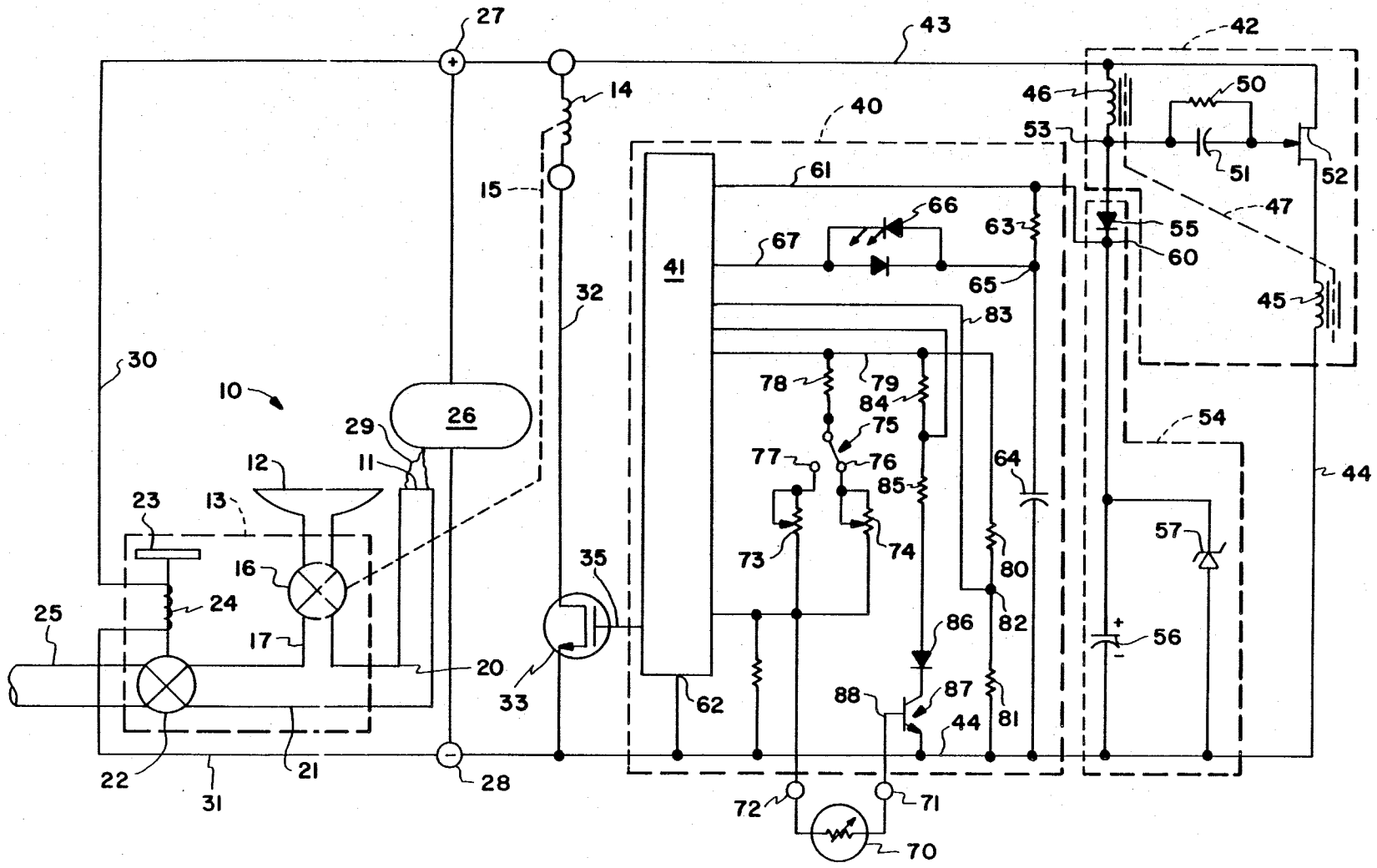
FIG. 1 is a complete schematic of a self-energizing burner control system incorporating a status indicator.

In FIG. 1 there is disclosed a complete self-energizing burner control system that includes a status indicator for the system. A fuel burner is generally disclosed at 10 and includes a pilot burner 11 and a main burner 12. Both of the burners 11 and 12 are connected through a fuel valve means 13 generally indicated by a dashed block. The fuel valve means 13 further includes a main fuel burner electromagnetic operating means or coil 14 that is linked at 15 to the actual valve mechanism disclosed at 16. The valve means 16 controls fuel to the main burner 12 from a pipe 17 which in fact is an internal passage of the fuel valve means 13.

The pilot burner 11 is connected at 20 to the passage 21 that is common with the passage 17 within the fuel valve means 13. The passage 21 is controlled by a fuel valve mechanism 22 that has a mechanical opening member 23 and a magnetic hold means or coil 24. The valve mechanism 22 is connected to a fuel pipe 25 that supplies fuel to both the pilot burner 11 and the main burner 12. The fuel valve means 13 can be of a type sold by Honeywell Inc. and identified as a VS820A,C combination gas control.

It will be understood that when fuel is present in the pipe 25, that the manual opener 23 can be operated thereby admitting fuel to the pipe or passage 21 and the pilot burner 11. If the fuel is ignited (normally manually), a flame 29 is provided. This flame impinges on a thermoelectric generator means 26 which has a positive output potential at 27 and a negative output potential at 28. The output potential of a typical thermoelectric generator means 26 is in the neighborhood of 0.75 volts direct current. It will be noted that the electromagnetic hold means or coil 24 is connected by conductors 30 and 31 to the potential at terminals 27 and 28. With the manual operator causing admission of fuel and the ignition of the fuel at the pilot burner 11, the electromagnetic hold means 24 is energized and the valve mechanism 22 is locked in an open position. This allows fuel to flow to the pilot burner 11 and to the main fuel valve 16.

As was indicated in the Background of the Invention, it is difficult to know how long the manual operator 23 must be held to provide a sufficient voltage at terminals 27 and 28 to cause the electromagnetic hold means 24 to be operative. Typically, the instructions with this type of a unit indicate three minutes. If the system is working very efficiently, that time could be substantially less. The present invention provides a means for detecting when the voltage is present, and allows for more rapid release of the manual opener 23 thereby adding significant convenience to this type of system.

The electromagnetic operator or coil 14 for the main fuel valve 16 is connected between the positive terminal 27 and the negative terminal 28 by means of a conductor 32 and a solid state switch means 33. The solid state switch means, when caused to conduct, will cause the valve means 16 to open admitting fuel to the main burner 12 where it is ignited by the pilot burner flame 29. It is thus apparent that the switching of the solid state switch means effectively controls the main burner 12.

The solid state switch means is driven at 35 from a solid state temperature control means 40. The solid state temperature control means 40 contains a number of discrete components that will be enumerated after a brief discussion of an integrated circuit 41. An integrated circuit 41 acts as a means for comparing and controlling with the use of a very low level of power. The integrated circuit 41 typically is a monolithic CMOS controller that utilizes an exceedingly limited amount of power in its operation. The particular monolithic CMOS controller disclosed could be of a type manufactured by Linear Technology and identified as their "Bang-Bang Controller LTC1041". This particular controller has been disclosed by way of example only, and any other very low power controller could be used.

The integrated circuit 41 typically operates in a sampling mode wherein the integrated circuit 41 samples for a very brief period of time and makes a control decision. The device then is at rest requiring an exceedingly low power drain. This function will be utilized in the novel concept for the present device and will be further explained below. The solid state temperature control means 40 further includes a number of discrete electronic components. The operation of the solid state control means and its discrete components can best be understood after certain other portions of the present circuit are disclosed.

An oscillator means is generally disclosed at 42, and is connected by a conductor 43 to the terminal 27 to receive a positive potential from the thermoelectric generator means 26. The oscillator means 42 is further connected by a conductor 44 to the negative terminal 28 of the thermoelectric generator means 26. The conductor 44 typically is the ground or common circuit for all of the device. Within the oscillator means 24 is a transformer having two windings 45 and 46 that are magnetically coupled at 47. A resistor and capacitor arrangement is further disclosed at 50 and 51 to control a field effect transistor 52. It is sufficient to understand that the oscillator means 42 when energized by a direct current potential on conductors 43 and 44 has an alternating current output voltage at a node 53.

The node 53 is connected to a power supply means generally disclosed at 54. The power supply means 54 includes a rectifying diode 55, a power storing capacitor 56, and a voltage regulating zener diode 57. This power supply provides a direct current potential of approximately five volts, regulated direct current, between the ground conductor 44 and a node 60.

The node 60 is connected by conductor 61 to the integrated circuit 41 of the solid state temperature control means 40. This supplies the normal energizing potential to the integrated circuit 41 which further has a ground or common connection at 62 to the conductor 44 which is the negative potential for the system. Also connected to the node 60 and conductor 61 is a resistor 63 and a capacitor 64 that establishes the sampling time of operation of the integrated circuit 41 in the solidstate temperature control means 40. The capacitor 64 charges through the resistor 63, and then discharges at a node 65 through a light emitting diode 66 to a conductor 67 that feeds back into the integrated circuit 41 where the energy is discharged in the sampling mode. Each time the capacitor 64 discharges through the light emitting diode 66, a flashing light is present and this can only occur when the proper level of voltage is available at node 60. Since a voltage can be present at 60 only when the thermoelectric generator means 26 is supplying the voltage, it is a clear indication that the thermoelectric generator means 26 is being properly heated and that the manual operator 23 no longer need be held.

The circuitry is completed by the addition of temperature control elements and the sensor means. A thermistor sensor is disclosed at 70 and typically would be connected at terminals 71 and 72 to a remote location where the temperature is being sensed. The present device has particular utility to swimming pool heaters which are used both for heating a swimming pool and can also be used for heating other equipment, such as hot tubs. As such, the present system utilizes a pair of calibration potentiometers 73 and 74 which are connected by a switch means 75 between terminals 76 and 77. The position of the switch means 75 selects which of the calibrating potentiometers 73 or 74 are effective. The switch means 75 is connected through a resistor 78 to a conductor 79 which is in turn connected to the integrated circuit 41 and to a voltage divider network made up of resistors 80 and 81. Resistors 80 and 81 have a node 82 that is connected by conductor 83 back to the integrated circuit 41. The voltage divider made up of resistors 80 and 81 form part of the necessary differential network for the integrated circuit 41 in the solid state temperature control means 40.

This solid state temperature control means is completed by the use of a voltage divider network made up of resistors 84 and 85, a diode 86, and a transistor generally disclosed at 87. The transistor 87 has an emitter connected to the conductor 44 and has its base connected by conductor 88 to the terminal 71. The function of this portion of the circuit will now be disclosed.

The voltage divider network made up of the resistors 84, 85, diode 86 and transistor 87 operate generally in parallel with the voltage divider network made up of the resistors 80 and 81. The presence of the proper resistance of thermistor 70 causes the transistor 87 to be functional, and implements the correct operation of the integrated circuit 41. In the event that the thermistor 70 is missing or is open circuited, the transistor 87 changes its mode of conduction and the integrated circuit 41 in the solid state temperature control means 40 is disabled and no output is provided on the conductor 35 to the solid state switch means 33. This would cause the electromagnetic operator 14 for the valve 16 to be deenergized, and the burner 12 would be without fuel. The transistor 87 and its associated circuitry provides a safety function to insure that the thermistor 70 is in place, and is of a proper magnitude in resistance.

A review of the operation of the device of FIG. 1 indicates that upon the operation of the manual opener 23 to admit fuel, the pilot burner 11 can be ignited. Upon ignition, the flame 29 impinges on the thermoelectric generator means 26 and provides energy to the oscillator means 42, and power supply 54 This stepped up level of direct current potential is supplied to the solid state temperature control means 40 and allows the solid state temperature control means 40 to have a controlled output on conductor 35 to in turn control conduction of the solid state switch means 33. This provides energy to the valve coil 14 to open the main fuel burner valve 16 and admit fuel. At the same time that this is occuring, the sampling circuits within the solid state temperature control means 40 cause repeated discharge of the capacitor 64 through the light emitting diode 66 into the integrated circuit 41. This causes the light emitting diode 66 to blink. With this arrangement the holding of the manual opener 23 can be limited and responsive to the visual indication provided by the light emitting diode 66.

The present circuitry also has the light emitting diode 66 as a continuing indication of satisfactory operation of the power supply means 54 and thermoelectric generator means 26. Further, the present system incorporates a voltage divider network including the transistor 87 to enable the solid state temperature control means 40 when the thermistor 70 is in proper working order, and to disable it in the event that the thermistor 70 is either missing or is of an improper value.

Figure 2:
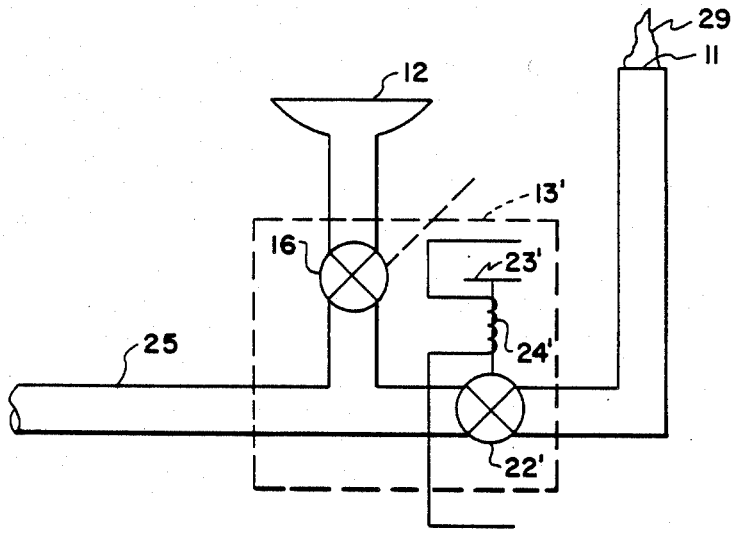
FIG. 2 is a disclosure of a second valve configuration.

In FIG. 2 there is disclosed a second form of fuel valve means 13'. The fuel valve means 13' has a pilot valve 22' operated by a manual opener 23' and is capable of being held open by a magnetic holding member or coil 24'. It will be noted that the pilot valve means 22' controls only the flow of fuel to the pilot burner 11. The main fuel valve means 16' is provided directly from the pipe 25 to the main burner 12.

The fuel valve means 13' disclosed in FIG. 2 would be an alternative arrangement where two physically unrelated valves are used as opposed to the preferred single valve structure 13 disclosed in FIG. 1.

It is apparent that a number of modifications of the present invention are possible and the applicant wishes to be limited in the scope of his invention solely by the scope of the appended claims.

The embodiments of the invention in which an exclusive property or right is claimed are defined as follows:

1. A status indicator for a self-energizing burner control system for burner means having a pilot burner and a main burner, including: fuel valve means for controlling fuel to said pilot burner and to said burner; said fuel valve means including manual opening means and electromagnetic hold means with said manual opening means arranged to operate to an open position of said valve means to admit said fuel to said pilot burner to permit ignition of fuel at said pilot burner which subsequently enables said electromagnetic hold means to hold said valve means in said open position for said pilot burner in said open position; said valve means further having electromagnetic operating means for control of said fuel to said main burner; thermoelectric generator means responsive to a flame from said pilot burner to generate a direct current potential as a sole source of electrical energy for said self-energizing burner control system; solid state switch means and said electromagnetic operating means for said valve means for control of said main burner connected in an electrical series circuit to said direct current potential wherein the operation of said solid state switch means controls said direct current potential to in turn control said valve means to admit said fuel to said burner; power converter means for converting said direct current potential and having an input connected to said thermoelectric generator means; said power converter means further having direct current power supply output means to supply a direct current potential substantially higher in voltage than the voltage from said thermoelectric generator means; solid state temperature control means for enabling and disabling said solid state switch means and being energized from said power converter means; said solid state temperature control means including a temperature sensor responsive to a temperature to be controlled; said temperature control means further having an output connected to said solid state switch means; said solid state temperature control means controlling said solid state switch means to energize said electromagnetic means for control of said fuel to said main burner; and circuit means including light emitting means connected to said solid state temperature control means with said light emitting means emitting a visible light when said solid state temperature control means is energized and functioning to thereby verify that said thermoelectric generator means is supplying sufficient power to operate said burner control system.

2. A status indicator for a self-energizing burner control system as claimed in claim 1 wherein said solid state temperature control means includes said circuit means having said light emitting means and further includes resistor means and capacitor means for forming a timing network; said capacitor means charged from said direct current power supply output means, and discharged through said light emitting means as said solid state temperature control means repeatedly samples said temperature sensor.

3. A status indicator for a self-energizing burner control system as claimed in claim 2 wherein said temperature sensor includes a variable resistor means and a thermistor both arranged in a further electrical series circuit.

4. A status indicator for a self-energizing burner control system as claimed in claim 3 wherein said light emitting means is a light emitting diode.

5. A status indicator for a self-energizing burner control system as claimed in claim 4 wherein said circuit means further includes a transistor controlled in response to said temperature sensor; and transistor in turn controlling said solid state temperature control means upon said temperature sensor being above a preselected resistance value to cause said fuel valve means to interrupt said fuel flow to said main burner.

* * * * *